United States Patent [19]

Aldridge et al.

[11] 4,298,454

[45] Nov. 3, 1981

[54] HYDROCONVERSION OF AN OIL-COAL MIXTURE

[75] Inventors: Clyde L. Aldridge; Roby Bearden, Jr., both of Baton Rouge, La.

[73] Assignee: Exxon Research and Engineering Company, Florham Park, N.J.

[21] Appl. No.: 83,671

[22] Filed: Oct. 11, 1979

Related U.S. Application Data

[63] Continuation-in-part of Ser. No. 702,271, Jul. 2, 1976, abandoned.

[51] Int. Cl.[3] ..... C10G 1/06

[52] U.S. Cl. ..... 208/10; 208/108

[58] Field of Search ..... 208/10

[56] References Cited

U.S. PATENT DOCUMENTS

| | | | |
|---|---|---|---|
| 3,502,564 | 3/1970 | Hodgson | 208/10 |
| 3,532,617 | 10/1970 | Hodgson | 208/10 |
| 4,077,867 | 3/1978 | Aldridge et al. | 208/10 |

*Primary Examiner*—Delbert E. Gantz
*Assistant Examiner*—William G. Wright
*Attorney, Agent, or Firm*—Marthe L. Gibbons

[57] ABSTRACT

A process for catalytically hydroconverting a mixture of coal and a hydrocarbonaceous oil is effected by forming a mixture of a thermally decomposable metal compound, oil and coal, converting the compound to a catalyst within the mixture and reacting the mixture with hydrogen. Preferred compounds are molybdenum compounds.

23 Claims, 2 Drawing Figures

HYDROCONVERSION OF AN OIL-COAL MIXTURE

CROSS-REFERENCE TO RELATED APPLICATIONS

This application is a continuation-in-part of U.S. application Ser. No. 702,271 filed July 2, 1976, now abandoned the teachings of which are hereby incorporated by reference.

BACKGROUND OF THE INVENTION

1. Field of the Invention

This invention relates to a process for simultaneously converting coal to liquid hydrocarbon products and hydroconverting a heavy hydrocarbonaceous oil in the presence of a catalyst prepared in situ from small amounts of metals added to a mixture of oil and coal as thermally decomposable metal compounds.

2. Description of the Prior Art

Hydrorefining processes utilizing catalysts in admixture with a hydrocarbonaceous oil are well known. The term "hydrorefining" is intended herein to designate a catalytic treatment, in the presence of hydrogen, of a hydrocarbonaceous oil to upgrade the oil by eliminating or reducing the concentration of contaminants in the oil such as sulfur compounds, nitrogenous compounds, metal contaminants and/or to convert at least a portion of the heavy constituents of the oil, such as pentane-insoluble asphaltenes or coke precursors, to lower boiling hydrocarbon products and to reduce the Conradson carbon residue of the oil.

U.S. Pat. No. 3,161,585 discloses a hydrorefining process in which a petroleum oil chargestock containing a colloidally dispersed catalyst selected from the group consisting of metals of Group VB and VIB, an oxide of said metal or a sulfide of said metal is reacted with hydrogen at hydrorefining conditions. This patent teaches that the concentration of the dispersed catalyst, calculated as the elemental metal, in the oil chargestock is from about 0.1 weight percent to about 10 weight percent of the initial chargestock.

U.S. Pat. No. 3,331,769 discloses a hydrorefining process in which a metal component (Group VB, Group VIB, iron group metal) colloidally dispersed in a hydrocarbonaceous oil is reacted in contact with a fixed bed of a conventional supported hydrodesulfurization catalyst in the hydrorefining zone. The concentration of the dispersed metal component which is used in the hydrorefining stage in combination with the supported hydrodesulfurization catalyst ranges from 250 ppm to 2,500 ppm.

U.S. Pat. No. 3,657,111 discloses a process for hydrorefining an asphaltene-containing hydrocarbon chargestock which comprises dissolving in the chargestock a hydrocarbon-soluble oxovanadate salt and forming a colloidally dispersed catalytic vanadium sulfide in situ within the chargestock by reacting the resulting solution, at hydrorefining conditions with hydrogen and hydrogen sulfide.

It is also known to convert coal to liquid products by hydrogenation of coal which has been impregnated with an oil soluble metal naphthenate or by hydrogenation of coal in a liquid medium, such as an oil having a boiling range of 250° to 325° C., containing an oil soluble metal naphthenate, as shown in Bureau of Mines Bulletin No. 622, published 1965, entitled "Hydrogenation of Coal in the Batch Autoclave", pages 24 to 28.

Concentrations as low as 0.01 percent metal naphthenate catalysts, calculated as the metal, were found to be effective for the conversion of coal.

U.S. Pat. No. 3,532,617 discloses a process for hydroconversion of coal to liquid products by impregnating coal with a first catalyst which may be a metal naphthenate and contacting the catalyst-impregnated coal with a second supported hydrogenative metal component under a hydrogen pressure of 500 to 3000 psig. A residual oil may be recycled to the hydroconversion zone.

It has now been found that the addition of a minor amount (e.g. less than 1,000 wppm) calculated as the metal, of a thermally decomposable compound of Groups IVB, VB, VIB, VIIB and VIII of the Periodic Table of Elements yield catalysts which are effective when used as a sole catalyst in a minor amount for the simultaneous hydroconversion of a heavy hydrocarbonaceous oil and the liquefaction of coal to liquid hydrocarbons in the presence of hydrogen.

The term "hydroconversion" with reference to the oil is used herein to designate a catalytic process conducted in the presence of hydrogen in which at least a portion of the heavy constituents and coke precursors (as measured by Conradson carbon residue) of the hydrocarbonaceous oil are converted at least in part to lower boiling hydrocarbon products while simultaneously reducing the concentration of nitrogenous compounds, sulfur compounds and metallic contaminants.

The term "hydroconversion" with reference to coal is used herein to designate a catalytic conversion of coal to liquid hydrocarbons in the presence of hydrogen.

SUMMARY OF THE INVENTION

In accordance with the invention, there is provided a process for simultaneously hydroconverting a nonhydrogen donor heavy hydrocarbon oil and coal in admixture, which comprises: (a) forming a mixture of said heavy hydrocarbon oil, coal and an added thermally decomposable metal compound, in an amount ranging from about 25 to about 950 weight parts per million, calculated as the elemental metal, based on said oil-coal mixture, said metal being selected from the group consisting of Groups IVB, VB, VIB, VIIB and VIII of the Periodic Table of Elements and mixtures thereof; (b) converting said thermally decomposable metal compound to a catalyst within said mixture in the presence of a hydrogen-containing gas by heating said mixture to an elevated temperature; (c) reacting the resulting mixture containing said catalyst with hydrogen under oil and coal hydroconversion conditions, in a hydroconversion zone, said catalyst being the sole catalyst in said hydroconversion zone, and (d) recovering a hydroconverted normally liquid hydrocarbon product.

DETAILED DESCRIPTION OF THE INVENTION

Figure 1:
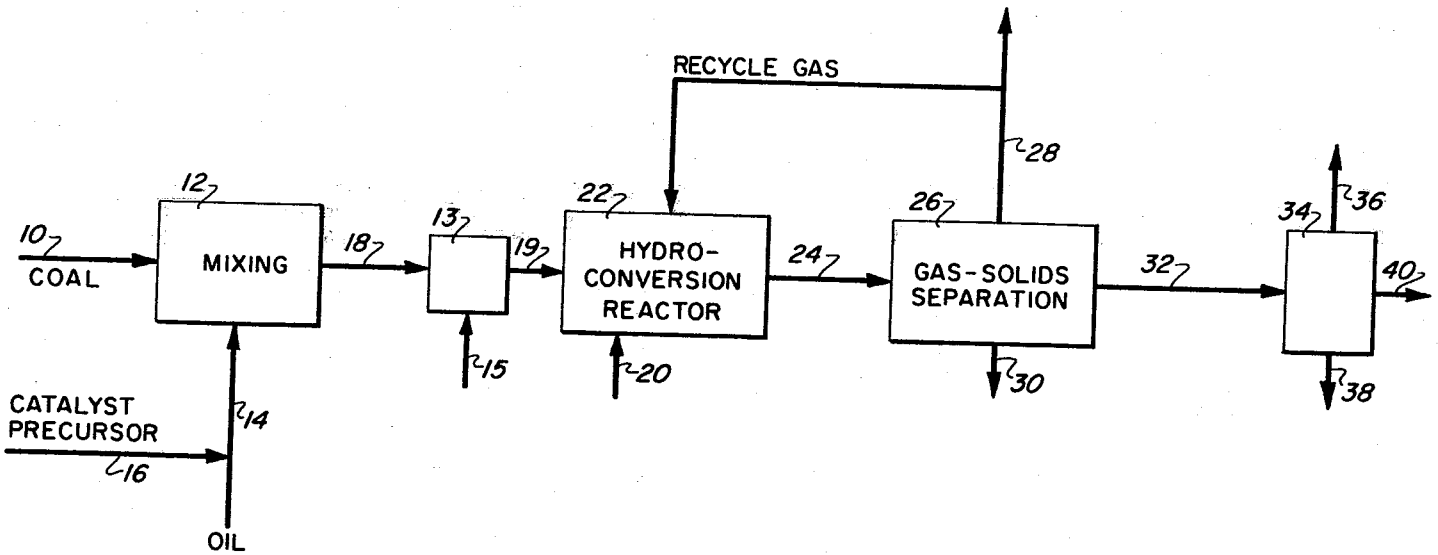
FIG. 1 is a schematic flow plan of one embodiment of the invention.

The process of the invention is generally applicable to mixtures comprising coal and a heavy hydrocarbonaceous oil. The mixture may comprise from about 2 to about 50 weight percent coal. Preferably, the mixture comprises from about 3 to about 20 weight percent coal, more preferably, from about 5 to about 10 weight percent coal. The term "coal" is used herein to designate a normally solid carbonaceous material including all ranks of coal, such as anthracite coal, bituminous coal, semibituminous coal, subbituminous coal, lignite, peat and mixtures thereof. The coal, in particulate form, of a size ranging up to about ⅛ inch particle size diameter, suitably 8 mesh (Tyler) diameter, is blended with a heavy hydrocarbon oil. The coal may be raw or beneficiated coal.

Suitable heavy hydrocarbonaceous oils for use in the process of the invention include non-hydrogen donor heavy mineral oils; hydrocarbon oils boiling above about 650° F.; whole or topped petroleum crude oils, including heavy crude oils; asphaltenes, residual oils such as petroleum atmospheric distillation tower residua (boiling above about 650° F., i.e. 343.33° C.), and petroleum vacuum distillation tower residua (vacuum residua boiling above about 1,050° F., i.e. 565.56° C.); tars, bitumens, tar sand oils; shale oils, coal liquefaction products, including coal liquefaction bottoms, etc. Particularly well suited oils are heavy crude oils and residual oils which generally contain a high content of metallic contaminants (nickel, iron, vanadium) usually present in the form of organometallic compounds, e.g. metalloporphyrins, a high content of sulfur compounds and a high content of nitrogenous compounds and a high Conradson carbon residue. The metal content of such oils may range up to 2,000 wppm or more and the sulfur content may range up to 8 weight percent or more. The API gravity at 60° F. of such oils may range from about −5° API to about ±35° API and the Conradson carbon residue of the heavy oil may generally range from about 5 to about 50 weight percent (as to Conradson carbon residue, see ASTM Test D-189-65). Preferably the hydrocarbonaceous oil is a heavy hydrocarbon oil having at least 10 weight percent of material boiling above 1,050° F. (565.56° C.) at atmospheric pressure, more preferably having more than about 25 weight percent of material boiling above 1,050° F. (565.56° C.) at atmospheric pressure. To the heavy hydrocarbon oil, either before adding the coal or after adding the coal, is added from about 10 to about 950 wppm, preferably from about 25 to 300 wppm, more preferably from about 50 to 200 wppm, of a metal as thermally decomposable metal compound wherein the metal is selected from the group consisting of Groups IVB, VB, VIB, VIIB, VIII and mixtures thereof of the Periodic Table of Elements, said weight being calculated as if the compound existed as the elemental metal, based on the total initial chargestock of oil and coal. If the compound is added to the hydrocarbon oil first, the coal is subsequently blended into the oil-metal compound mixture. Alternatively, the coal may be blended with the oil prior to the addition of the metal compound. Preferably the metal compound is added to the oil prior to the addition of the coal.

Suitable thermally decomposable metal compounds (convertible under process conditions) to a catalyst include (1) inorganic metal compounds such as halides, oxyhalides, heteropoly acids (e.g. phosphomolybdic acid, molybdosilicic acid); (2) metal salts of organic acids such as acyclic and alicyclic aliphatic carboxylic acids, containing two or more carbon atoms (e.g. naphthenic acids); aromatic carboxylic acids (e.g. toluic acid); sulfonic acids (e.g. toluenesulfonic acid); sulfinic acids; mercaptans; xanthic acids; phenols, di and polyhydroxy aromatic compounds; (3) organometallic compounds such as metal chelates, e.g. with 1,3-diketones, ethylene diamine, ethylene diamine tetraacetic acid, phthalocyanines, etc.; (4) metal salts of organic amines such as aliphatic amines, aromatic amines, and quaternary ammonium compounds.

The metal constituent of the thermally decomposable metal compound is selected from the group consisting of Groups IVB, VB, VIB, VIIB and VIII of the Periodic Table of Elements, and mixtures thereof, in accordance with the table published by E. H. Sargent and Company, copyright 1962, Dyna Slide Company, that is, titanium, zirconium, vanadium, niobium, tantalum, chromium, molybdenum, tungsten, manganese, rhenium, iron, cobalt, nickel, and the noble metals including platinum, iridium, palladium, osmium, ruthenium and rhodium. The preferred metal constituent of the thermally decomposable metal compound is selected from the group consisting of molybdenum, vanadium and chromium. More preferably, the metal constituent of the thermally decomposable metal compound is selected from the group consisting of molybdenum and chromium. Most preferably the metal constituent of the thermally decomposable metal compound is molybdenum. Preferred compounds of the given metals include the salts of acyclic (straight or branched chain) aliphatic carboxylic acids, salts of alicyclic aliphatic carboxylic acids, heteropolyacids, hydrated oxides, carbonyls, phenolates and organo amine salts. One more preferred type of metal compound is the heteropoly acid, e.g. phosphomolybdic acid. Another more preferred metal compound is a salt of an alicyclic aliphatic carboxylic acid such as a metal naphthenate. The most preferred compounds are molybdenum naphthenate, vanadium naphthenate and chromium naphthenate.

When the thermally decomposable metal compound is added to the hydrocarbonaceous oil, it disperses in the oil and subsequently, under pretreatment or under hydroconversion conditions herein described is converted to a solid catalyst comprising from about 10 to about 950 wppm, preferably from about 25 to about 300 wppm, more preferably from about 50 to about 200 wppm of the same metal or metals as the metal or metals added as thermally decomposable compound, calculated as the elemental metal based on the chargestock oil-coal mixture.

Various methods can be used to convert the dispersed metal compound in the oil to an active catalyst. A preferred method (pre-treatment method) of forming a catalyst from the thermally decomposable metal compound of the present invention is to heat the mixture of metal compound, hydrocarbon oil and coal to a temperature ranging from about 325° C. to about 415° C. and at a pressure ranging from about 500 to about 5,000 psig in the presence of a hydrogen-containing gas. Preferably, the hydrogen-containing gas also comprises hydrogen sulfide. The hydrogen sulfide may comprise from about 1 to about 90 mole percent, preferably from about 1 to 50 mole percent, more preferably from about 1 to 30 mole percent, of the hydrogen-containing gas mixture. The pretreatment is conducted for a period ranging from about 5 minutes to about 2 hours, preferably for a period ranging from about 10 minutes to about 1 hour. The thermal treatment in the presence of hydrogen or in the presence of hydrogen and hydrogen sulfide is believed to facilitate conversion of the metal compounds to the corresponding metal-containing active catalysts which act also as coking inhibitors. The oil-coal mixture containing the resulting catalyst is then introduced into a hydroconversion zone which will be subsequently described.

Another method of converting the thermally decomposable metal compound of the present invention is to react the mixture of compound in oil plus coal with a hydrogen-containing gas at hydroconversion conditions to produce a catalyst in the chargestock in situ in the hydroconversion zone. The hydrogen-containing gas may comprise from about 1 to about 10 mole percent hydrogen sulfide. The thermal treatment of the metal compound and reaction with the hydrogen-containing gas or with the hydrogen and hydrogen sulfide produces the corresponding metal-containing conversion product which is an active catalyst. Whatever the exact nature of the resulting conversion products of the given metal compounds, the resulting metal component is a catalytic agent and a coking inhibitor.

The catalyst of the present invention is used as the sole catalyst in the hydroconversion zone, that is, in the absence of any other catalyst that is extraneous to the process. Catalytic solids which result from the process, may, however be recycled.

The hydroconversion zone is maintained at a temperature ranging from about 416° to 538° C. (780.8° to 1000° F.), preferably from about 426° to 468° C. (799° to 874.4° F.), and at a hydrogen partial pressure of 500 psig or higher, preferably from about 500 to about 5,000 psig partial pressure of hydrogen. Reaction time of about 5 minutes to several hours may be used, preferably from about 15 minutes to about 2 hours. Contact of the mixture of coal, oil and catalyst under the hydroconversion conditions in the reaction zone with the hydrogen-containing gas effects a simultaneous hydroconversion of the oil and the coal. Preferably at least about 50 weight percent, more preferably at least about 75 weight percent of the oil is converted to products boiling below the initial boiling point of the heavy oil used in the chargestock mixture. All boiling points herein refer to atmospheric pressure boiling points unless otherwise specified. The hydroconversion zone oil product containing catalytic solids is removed from the hydroconversion reaction zone. The catalytic solids may be separated from the hydroconversion zone oil product by conventional means, for example, by settling or centrifuging of the slurry. At least a portion of the separated catalytic solids or solids concentrate may be recycled directly to the hydroconversion zone or recycled to the chargestock. The process of the invention may be conducted either as a batch or as a continuous type operation.

DESCRIPTION OF THE PREFERRED EMBODIMENTS

The preferred embodiments will be described with reference to the accompanying figures.

Referring to FIG. 1, coal in particulate form, of a size ranging up to about ⅛ inch particle size diameter, suitably 8 mesh (Tyler) is introduced by line 10 into a mixing zone 12 in which it is mixed with a petroleum atmospheric residuum, that is, a fraction having an atmospheric pressure boiling point of 650° F.+ (343.3° C.+) introduced into the mixing zone by line 14. A thermally decomposable metal compound is added to the residuum by line 16 so as to form a mixture of thermally decomposable metal compound, residuum and coal in mixing zone 12. The thermally decomposable metal compound, preferably a phosphomolybdic acid, is added to the residuum in an amount such as to comprise less than 300 weight parts per million (wppm), calculated as if it existed as the elemental metal, based on the total initial mixture of coal and residuum. The mixture is removed from the mixing zone by line 18 and introduced into pretreatment zone 13 into which a gaseous mixture comprising hydrogen and from about 1 to about 50 mole percent hydrogen sulfide is introduced by line 15. The pretreatment zone is maintained at a temperature ranging from about 342° C. to about 400° C. and at a total pressure ranging from about 500 to about 5000 psig. The pretreatment is conducted for a period of time ranging from about 10 minutes to about 1 hour. The pretreatment zone effluent is removed by line 19. If desired, a portion of the hydrogen sulfide may be removed from the effluent. The pretreatment zone effluent is introduced by line 19 into hydroconversion reactor 22 at a space velocity of 0.5 to 2 volumes of feed per hour per volume of reactor. A hydrogen-containing gas is introduced into hydroconversion reactor 22 by line 20. The hydrocarbon reaction zone in reactor 22 is maintained at a temperature ranging from about 799° to 874.4° F. (426° to 468° C.) and under a hydrogen partial pressure ranging from about 1000 to 3000 psig. The hydroconversion reactor effluent is removed from the zone by line 24. The effluent comprises gases, normally liquid hydrocarbon products produced by the hydroconversion of the coal and of the residuum, and a solid residue.

The effluent is passed to a separation zone 26 from which gases are removed overhead by line 28. This gas may be scrubbed by conventional methods to remove any undesired amount of hydrogen sulfide and carbon dioxide and thereafter, the scrubbed gas may be recycled into the hydroconversion zone to provide at least a portion of the required hydrogen-containing gas. The solids are removed from the separation zone 26 by line 30. The liquids are removed from separation zone 26 by line 32 and passed to a fractionation zone 34 wherein a light fraction is recovered by line 36, a heavy fraction is removed by line 38 and an intermediate fraction is removed by line 40.

Figure 2:
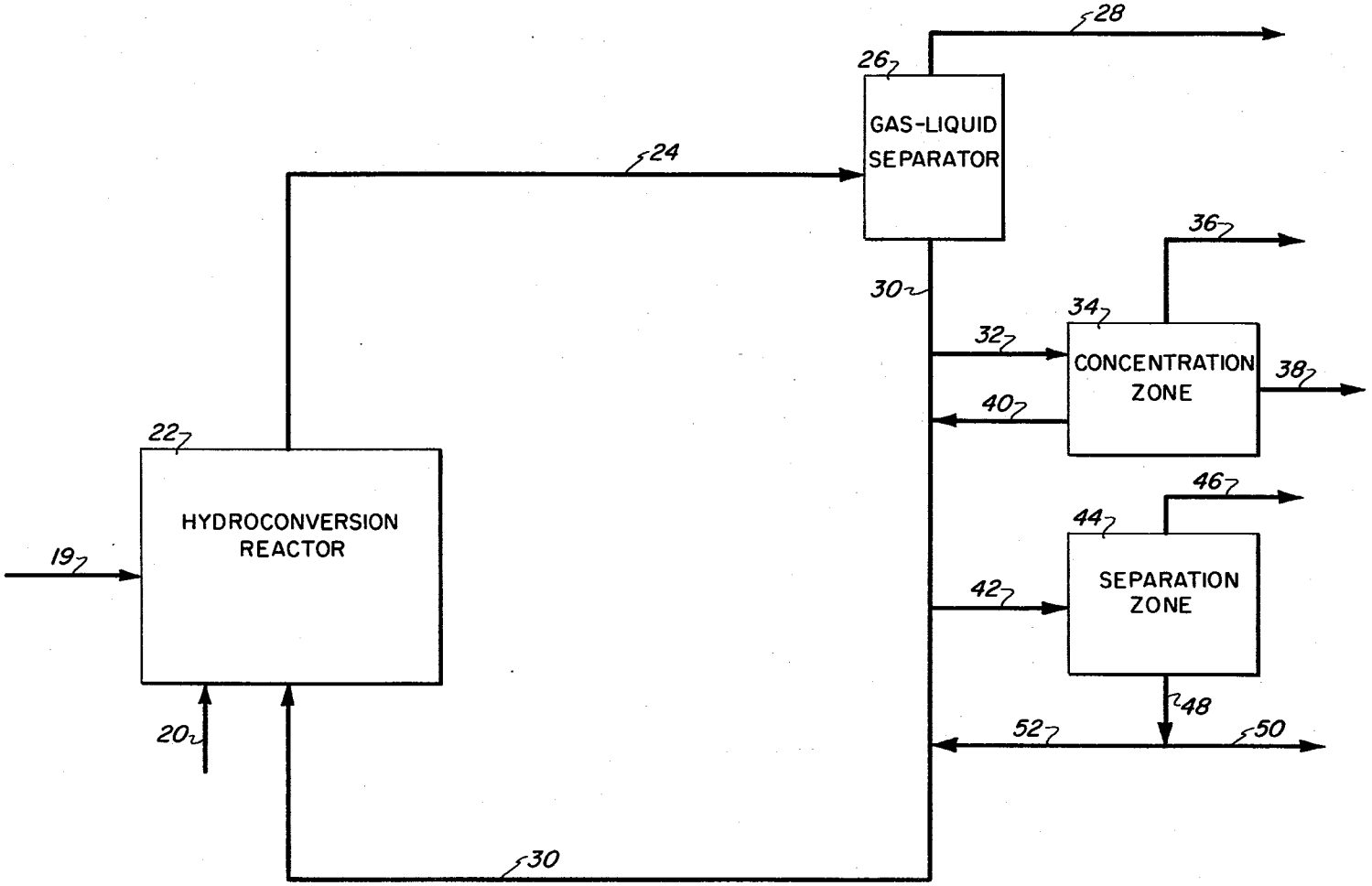
FIG. 2 is a schematic flow plan of another embodiment of the invention.

FIG. 2 shows various process options for treating the hydroconversion reaction zone effluent which is removed from hydroconversion reactor 22 by line 24.

The effluent is introduced into a gas-liquid separator 26 where hydrogen and light hydrocarbons are removed overhead by line 28. Three preferred process options are available for the liquid stream containing dispersed catalyst solids which emerges from separator vessel 26 via line 30. In process option to be designated "A", the liquid-solids stream is fed by line 32 to concentration zone 34 where by means, for example, of distillation, solvent precipitation or centrifugation, the stream is separated into a clean liquid product, which is withdrawn through line 36, and a concentrated slurry (i.e. 20 to 40% by weight) in oil. At least a portion of the concentrated slurry can be removed as a purge stream through line 38, to control the build-up of solid materials in the hydroconversion reactor, and the balance of the slurry is returned by line 40 and line 30 to hydroconversion reactor 22.

The purge stream may be filtered subsequently to recover catalyst and liquid product, or it can be burned or gasified to provide, respectively, heat and hydrogen for the process. In process option to be designated "B", the purge stream from concentration zone 34 is omitted and the entire slurry concentrate withdrawn through line 40 is fed to separation zone 44 via lines 30 and 42. In this zone, a major portion of the remaining liquid phase is separated from the solids by means of centrifugation, filtration or a combination of settling and drawoff, etc. Liquid is removed from the zone through line 46 and solids through line 48. At least a portion of the solids and associated remaining liquid are purged from the process via line 50 to control the build-up of solids in the process, and the balance of the solids is recycled to hydroconversion reactor 22 via line 52 which connects to recycle line 30. The solids can be recycled either as recovered or after suitable clean-up (not shown) to remove heavy adhering oil deposits and coke.

In option designated "C", the slurry of solids in oil exiting from separator 26 via line 30 is fed directly to separation zone 44 by way of line 42 whereupon solids and liquid product are separated by means of centrifugation or filtration. All or part of the solids exiting from vessel 44 via line 48 can be purged from the process through line 50 and the remainder recycled to the hydroconversion reactor. Liquid product is recovered through line 46. If desired, at least a portion of the heavy fraction of the hydroconverted oil product may be recycled to the hydroconversion zone.

The following examples are presented to illustrate the invention.

EXAMPLE 1

Experiments were made utilizing a 50/50 mixture of Athabasca bitumen and Wyodak coal. Prior to conducting runs 88, 90, 91 and 119, the mixture of coal, bitumen and added molybdenum naphthenate (when present) was pretreated for 30 minutes at a temperature of 385° C., with hydrogen at 2000+ psig. The hydroconversion reactions were conducted for 60 minutes at 2000+ psig hydrogen at the indicated temperatures. Results of these tests are summarized in Table I.

Comparison of run 90 and run 88 (the control run) shows that the presence of molybdenum reduces coke yield and increased oil yields.

TABLE I

HYDROCONVERSION OF 50/50 ATHABASCA BITUMEN/WYODAK COAL

| Run No. | 88 | 90 | 91 | 119 |
|---|---|---|---|---|
| Molybdenum, ppm | None | 250 | 275 | 1120 |
| Temperature, °F. | 850 | 850 | 820 | 820 |
| Carbon in Total Feed Converted to, % | | | | |
| $C_1$-$C_3$ Hydrocarbon Gas | 6.87 | 7.06 | 3.82 | 4.09 |
| $CO + CO_2$ | 3.28 | 3.22 | 2.96 | 2.69 |
| Oil | 59.49 | 65.28 | 78.15 | 85.08 |
| Coke | 30.36 | 24.42 | 15.07 | 8.14 |

TABLE I-continued

HYDROCONVERSION OF 50/50 ATHABASCA BITUMEN/WYODAK COAL

| Run No. | 88 | 90 | 91 | 119 |
|---|---|---|---|---|
| Carbon in Coal Converted to Coke, %(1) | 71.84 | 57.77 | 35.68 | 19.16 |
| Hydrogen Consumption Moles/100 g. Feed | 0.9070 | 1.0933 | 1.0498 | 1.1892 |
| Oil Analyses | | | | |
| Sulfur, % | 1.71 | 1.42 | 1.69 | 1.51 |
| Ni, ppm | 3 | 1 | 5 | 6 |
| Fe, ppm | 6 | 0 | 0 | 0 |
| V, ppm | 0 | 1 | 10 | 7 |
| Con. Carbon, % | 4.36 | 3.74 | 5.91 | 6.53 |
| API Gravity, 60° F. | 25.7 | 27.4 | 2.07 | 20.2 |

(1)A small to substantially negligible amount of the petroleum feed is converted to coke under these conditions. Thus, to a first approximation all the coke may be viewed as derived from the coal.

EXAMPLE 2

Experiments were made utilizing mixtures of coal and a heavy hydrocarbonaceous oil. The results of these experiments are summarized in Table II.

In run 178, a mixture of 44.96 g. of Cold Lake crude oil and 44.96 g. of 200 mesh lignite was charged to a stirred 300 cc Hastelloy autoclave together with 1.30 g. of molybdenum naphthenate (containing 6% molybdenum). The molybdenum on feed thus was 857 ppm. The autoclave was flushed with hydrogen and pressured to 2000 psig. The hydrogen was then measured by venting through a wet test meter. The autoclave was repressured to 2000 psig with hydrogen, heated to 820° F. with stirring, held at this temperature with stirring for 60 minutes, then quickly cooled. The gases were then measured and analyzed by mass spectrometric analysis. The contents of the autoclave were then discharged and filtered to recover oil. The autoclave was washed with toluene to recover remaining solids and all the solids then toluene washed with vacuum dried at 185° C. The solids were then analyzed for carbon and hydrogen. Yields of gases, oil and coke were then calculated on a carbon balance basis.

Run 181 is a run similar to run 178 except that no catalyst was used.

Run 179 is a run similar to run 178. However, the feed utilized was a 50/50 mixture of Athabasca bitumen and 200 mesh Wyodak coal. The molybdenum concentration was 837 ppm.

Run 180 was a run similar to run 179 except that no catalyst was used.

In runs 178, 181, 179 and 180, the feed mixture (and catalyst where used) was not pretreated prior to the reaction.

TABLE II

HYDROCONVERSION OF MIXTURES OF COAL AND HEAVY PETROLEUM OIL

| Run No. | 178 | 181 | 179 | 180 | | |
|---|---|---|---|---|---|---|
| Feed | Cold Lake/Lignite Crude | | Athabasca Bitumen/ Coal | | Athabasca Feed | Cold Lake Feed |
| Molybdenum, ppm | 857 | 0 | 837 | 0 | | |
| Carbon in Total Feed Converted to, % | | | | | | |
| $C_1$-$C_3$ Gas | 4.00 | 4.34 | 4.26 | 4.63 | | |
| $CO + CO_2$ | 2.01 | 2.25 | 2.69 | 3.01 | | |
| Oil | 88.59 | 63.52 | 84.28 | 70.96 | | |
| Coke | 5.40 | 29.89 | 8.77 | 21.40 | | |
| Carbon in Coal Converted to Coke, %(1) | 13.48 | 74.76 | 20.65 | 50.28 | | |
| Hydrogen Consumption, moles/100 g. Feed | 0.9968 | — | 1.1276 | 0.6116 | | |
| Oil Analyses | | | | | | |

TABLE II-continued

| HYDROCONVERSION OF MIXTURES OF COAL AND HEAVY PETROLEUM OIL | | | | | | |
|---|---|---|---|---|---|---|
| Run No. | 178 | 181 | 179 | 180 | | |
| Sulfur, % | 1.50 | 1.98 | 1.43 | 2.00 | 4.14 | 4.32 |
| Ni, ppm | 14 | 6 | 5 | 5 | 63 | 74 |
| Fe, ppm | 2 | 4 | 1 | 1 | 186 | 18 |
| V, ppm | 9 | 5 | 7 | 6 | 174 | 159 |
| Conradson Carbon, % | 6.9 | 5.4 | 6.5 | 6.2 | 13.3 | 13.2 |
| API Gravity, 60° F. | 19.2 | 21.1 | 19.4 | 20.5 | 10 | 10 |

(1)A small to substantially negligible amount of the petroleum oil feed is converted to coke under these conditions. Thus, to a first approximation all the coke may be viewed as derived from the coal.

EXAMPLE 3

Experiments were made utilizing a 50/50 Athabasca bitumen/Wyodak coal mixture using the general procedure described in Example 2. Runs 188, 209, 216 and 119 were given the indicated pretreats at 2000+ psig before the hydroconversion reaction was carried out. Runs 180, 191, 179 and 208 were given no pretreat. The hydroconversion reactions were carried out with average hydrogen partial pressure during the runs somewhat above 2000 psig. Where used, the amount of $H_2S$ in pretreat was similar to the amount used in hydroconversion reactions as the total gas pressure at room temperature was 1500 psig prior to pretreat, whereas the initial pressure at room temperature for hydroconversion reactions where $H_2S$ was used was 2150 psig.

Results are summarized in Table III.

Comparison of Run 191 vs. 180 shows that addition of $H_2S$ to the hydroconversion reaction when no added catalyst is present has a deleterious effect on coke suppression and oil yield.

Comparison of Run 188 vs. 180 shows that pretreat with an $H_2S$ containing gas has a small favorable effect on coke suppression and oil yield when no catalyst is added.

Comparison of Run 179 vs. Run 180 shows the large favorable effect of the addition of a thermally decomposable molybdenum compound on coke suppression and oil yield.

Comparison of Run 119 vs. Run 179 shows that pretreat with hydrogen with a thermally decomposable molybdenum compound added has a small favorable effect on coke suppression and oil yield.

Comparison of Run 208 vs. Run 179 shows that addition of $H_2S$ to the hydroconversion treat gas when a thermally decomposable molybdenum compound is added has a small adverse effect on coke suppression and oil yield.

Comparison of Run 209 vs. Run 119 shows that pretreat with an $H_2S$ containing gas has a major favorable effect on coke suppression and oil yield when a thermally decomposable molybdenum compound is added.

Comparison of Run 222 vs. 209 shows that $H_2$ along with $H_2S$ in the pretreatment is essential. Thus, the overall conclusion, by comparing runs 209 and 222 and 180, is that by using the combination of an oil soluble molybdenum compound and pretreatment with a mixture of $H_2$ and $H_2S$ that substantially complete suppression of coke formation and maximum oil yield are obtainable.

TABLE III

| EFFECT OF $H_2S$ IN PRETREAT AND IN HYDROCONVERSION<br>Feed 50/50 Athabasca Bitumen/Wyodak Coal<br>Molybdenum added as molybdenum naphthenate | | | | | | | | |
|---|---|---|---|---|---|---|---|---|
| Run No. | 180 | 188 | 191 | 179 | 209 | 208 | 119 | 222 |
| Molybdenum, ppm | None | None | None | 837 | 1087 | 1088 | 1120 | 1090 |
| Pretreat | | | | | | | | |
| Temperature, °F. | — | 725 | — | — | 725 | — | 725 | 725 |
| Time, Min. | — | 30 | — | — | 30 | — | 30 | 30 |
| Gas Composition | — | 13% $H_2S$/$H_2$ | — | — | 13% $H_2S$/$H_2$ | — | $H_2$ | 13% $H_2S$/$N_2$ |
| Hydroconversion | | | | | | | | |
| Temperature, °F. | 820 | 820 | 820 | 820 | 820 | 820 | 820 | 820 |
| Time, Min | 60 | 60 | 60 | 60 | 60 | 60 | 60 | 60 |
| Gas Composition | $H_2$ | $H_2$ | 7% $H_2S$/$H_2$ | $H_2$ | $H_2$ | 7% $H_2S$/$H_2$ | $H_2$ | $H_2$ |
| Carbon in Total Feed Converted to, % | | | | | | | | |
| $C_1$-$C_3$ Hydrocarbon Gas | 4.63 | 4.25 | 5.65 | 4.26 | 2.90 | 4.48 | 4.09 | 5.17 |
| $CO + CO_2$ | 3.01 | 2.55 | 2.79 | 2.69 | 2.55 | 2.37 | 2.69 | 2.59 |
| Oil | 70.96 | 76.04 | 64.76 | 84.28 | 93.21 | 82.67 | 85.08 | 84.93 |
| Coke | 21.40 | 17.16 | 26.80 | 8.77 | 1.34 | 10.48 | 8.14 | 7.31 |
| Carbon in Coal Converted to Coke, %(1) | 50.28 | 40.20 | 62.80 | 20.65 | 3.15 | 24.97 | 19.16 | 17.29 |
| Hydrogen Consumption Moles/100 g. Feed | 0.6116 | 0.6928 | — | 1.1276 | 0.8456 | — | 1.1892 | 1.1011 |
| Oil Analyses | | | | | | | | |
| Sulfur, % | 2.00 | 2.13 | 2.02 | 2.00 | 1.23 | 1.85 | 1.51 | 1.29 |
| Ni, ppm | 5 | 9 | 6 | 5 | 3 | 5 | 6 | 7 |
| Fe, ppm | 1 | 1 | 7 | 1 | 0 | 0 | 0 | 0 |
| V, ppm | 6 | 13 | 11 | 7 | 5 | 24 | 7 | 12 |
| Con. Carbon, % | 6.1 | 7.5 | 6.4 | 6.5 | 8.0 | 7.1 | 6.5 | 8.5 |
| API Gravity, 60° F. | 20.5 | — | — | 19.4 | 15.2 | 18.5 | 20.2 | — |

(1)A small to substantially negligible amount of petroleum feed is converted to coke under these conditions. Thus, to a first approximation all the coke may be viewed as derived from the coal.

EXAMPLE 4

A 50/50 weight mixture of Athabasca bitumen and 100 mesh (Tyler) Wyodak coal was mixed with molybdenum naphthenate in the amount of 200 wppm molybdenum and reacted with a 95.3% $H_2$/4.7% $H_2S$ gas mixture in an autoclave at 820° F. (437.7° C.) and 2450 psig for a period of 90 minutes.

Distillation of the liquid product by 15/5 distillation showed the following yields expressed as volume percent on the Athabasca bitumen feed. It can be seen from Table IV under these conditions that the conversion of the bitumen is above 50% and the conversion of coal is much higher with the product derived from the coal being mainly naphtha.

TABLE IV

| Liquid Product, Vol. % on Athabasca Feed | From Bitumen | From 50/50 wt. Bitumen/Coal | From Coal |
|---|---|---|---|
| $C_4$-380° F. | 13 | 51 | 38 |
| 380-650° F. | 39 | 50 | 11 |
| 650-1050° F. | 39 | 54 | 15 |
| 1050° F.+ | 11 | 13 | 2 |

EXAMPLE 5

Comparative experiments were performed utilizing a heavy oil feed alone (Cold Lake Crude Oil) and a mixture of Cold Lake Crude Oil comprising a small proportion of coal, such as 3 weight percent coal. The results of these experiments are shown in Table V.

TABLE V

Batch Autoclave Tests
2000 psig $H_2$ charged at room temp.
Run @ 385° C. for 30 min., followed by 1 Hr. @ 438° C.
350 wppm Mo on feed.*

| Run No. | 172 | R-271 | Cold Lake Feed |
|---|---|---|---|
| Feed Comp., wt. % | | | |
| Cold Lake Crude | 100 | 97 | |
| Illinois Coal | — | 3 | |
| Yields, wt. % on Cold Lake Crude | | | |
| $C_1$-$C_3$ | 2.54 | 2.50 | |
| Coke | 0.37 | 0.93 | |
| $C_4$ + Liquid | 97.09 | 98.94 | |
| Inspections of $C_4$ + Liquid | | | |
| Sulfur, wt. % | 2.1 | 2.1 | 4.3 |
| Nickel, wppm | 9 | 15 | 74 |
| Vanadium, wppm | 11 | 23 | 165 |
| Conradson Carbon, wt. % | 6.7 | 6.9 | 12.9 |

*Furnished as molybdenum naphthenate.

As can be seen from Table V, use of the mixture comprising 3 weight percent coal and Cold Lake Crude resulted in an increase in $C_4$+ liquid yield from 97.09 to 98.94 weight percent on Cold Lake Crude. The properties of the oil containing the coal liquids are substantially the same as those of the liquid product obtained from Cold Lake Crude alone (Run 172).

What is claimed is:

1. A process for simultaneously hydroconverting a non-hydrogen donor heavy hydrocarbon oil and coal in admixture, which comprises:
   (a) forming a mixture of said heavy hydrocarbon oil, coal and an added thermally decomposable metal compound, in an amount ranging from about 10 to about 950 weight parts per million, calculated as the elemental metal, based on said oil-coal mixture, said metal being selected from the group consisting of Groups IVB, VB, VIB, VIIB and VIII of the Periodic Table of Elements and mixtures thereof;
   (b) converting said thermally decomposable metal compound to a catalyst within said mixture in the presence of a hydrogen-containing gas by heating said mixture to an elevated temperature;
   (c) reacting the resulting mixture containing said catalyst with hydrogen under oil and coal hydroconversion conditions, such that at least 50 weight percent of said heavy oil has a boiling point below the initial boiling point of said heavy oil, in a hydroconversion zone, said catalyst being the sole catalyst in said hydroconversion zone, and
   (d) recovering a hydroconverted normally liquid hydrocarbon product.

2. The process of claim 1 wherein said coal comprises from 2 to 50 weight percent of said mixture of step (a).

3. The process of claim 1 wherein said coal comprises from about 3 to 20 weight percent of said mixture of step (a).

4. The process of claim 1 wherein said thermally decomposable metal compound is selected from the group consisting of inorganic metal compounds, salts of organic acids, organometallic compounds and salts or organic amines.

5. The process of claim 1 wherein said thermally decomposable metal compound is selected from the group consisting of salts of acyclic aliphatic carboxylic acids and salts of alicyclic aliphatic carboxylic acids.

6. The process of claim 1 wherein said thermally decomposable metal compound is a salt of napthenic acid.

7. The process of claim 1 wherein the metal constituent of said thermally decomposable metal compound is selected from the group consisting of molybdenum, chromium and vanadium.

8. The process of claim 1 wherein said thermally decomposable metal compound is molybdenum naphthenate.

9. The process of claim 1 wherein said thermally decomposable metal compound is a phosphomolybdic acid.

10. The process of claim 1 wherein said hydrogen-containing gas of step (b) comprises from about 1 to about 90 mole percent hydrogen sulfide.

11. The process of claim 1 wherein said thermally decomposable metal compound is converted by first heating the mixture of thermally decomposable metal compound, oil and coal to a temperature ranging from about 325° C. to about 415° C. in the presence of said hydrogen-containing gas to form a catalyst within said mixture and subsequently reacting the resulting mixture containing the catalyst with hydrogen under hydroconversion conditions.

12. The process of claim 12 wherein said hydrogen-containing gas also contains hydrogen sulfide.

13. The process of claim 1 wherein said thermally decomposable metal compound is converted in the presence of a hydrogen-containing gas at hydroconversion conditions thereby forming said catalyst in situ within said mixture in said hydroconversion zone and producing a hydroconverted oil.

14. The process of claim 1 wherein said hydroconversion conditions include a temperature ranging from about 416° to about 538° C. (780.8° to 1000° F.) and a hydrogen pressure of at least 500 psig.

15. In the process of claim 1 wherein the reaction product of step (c) comprises a hydroconverted oil containing catalytic solids, the additional steps which comprise separating at least a portion of said catalytic solids from the hydroconverted oil and recycling at least a portion of said solids to step (a) or to step (c).

16. A process for simultaneously hydroconverting a non-hydrogen donor heavy hydrocarbon oil and coal in admixture, which comprises:

(a) forming a mixture of said heavy hydrocarbon oil, coal and an added thermally decomposable metal compound, said metal compound being added in an amount ranging from about 10 to about 950 weight parts per million, calculated as the elemental metal, based on said oil-coal mixture, said metal being selected from the group consisting of Groups IVB, VB, VIB, VIIB and VIII of the Periodic Table of Elements and mixtures thereof;

(b) heating the mixture resulting from step (a) to a temperature ranging from 325° C. to about 415° C. in the presence of a hydrogen-containing gas to form a catalyst within said mixture, said catalyst comprising from about 10 to about 950 wppm of said metal, calculated as the elemental metal, based on said oil-coal mixture;

(c) reacting the resulting mixture containing said catalyst with hydrogen under hydroconversion conditions in a hydroconversion zone including a temperature ranging from about 416° C. to about 538° C. (780.8° to 1000° F.) and a hydrogen pressure ranging from about 500 to about 5000 psig, said catalyst being the sole catalyst in said hydroconversion zone, and (d) recovering a hydroconverted oil.

17. The process of claim 16 wherein said hydrogen-containing gas of step (b) comprises from about 1 to about 90 mole percent hydrogen sulfide.

18. The process of claim 16 wherein said thermally decomposable metal compound is a molybdenum compound.

19. The process of claim 16 wherein said thermally decomposable metal compound is molybdenum naphthenate.

20. The process of claim 16 wherein said thermally decomposable metal compound is a phosphomolybdic acid.

21. The process of claim 16 wherein said metal compound in step (a) is added in an amount ranging from about 25 to about 300 weight parts per million.

22. In the process of claim 16 wherein the reaction product of step (c) comprises a hydroconverted oil containing catalytic solids, the additional steps which comprise separating at least a portion of said catalytic solids from the hydroconverted oil and recycling at least a portion of said catalytic solids to step (a) or to step (c).

23. The process of claim 16 wherein said heavy oil is hydroconverted in step (c) so that at least 50 weight percent thereof has a boiling point below the initial boiling point of said heavy oil.

* * * * *